United States Patent [19]

Ruda

[11] 4,071,186

[45] Jan. 31, 1978

[54] SELF-CLOSING BAG

[75] Inventor: Raymond J. Ruda, Chicago, Ill.

[73] Assignee: Bagcraft Corporation of America, Chicago, Ill.

[21] Appl. No.: 696,270

[22] Filed: June 15, 1976

[51] Int. Cl.[2] ..... B65D 33/16

[52] U.S. Cl. ..... 229/62

[58] Field of Search ..... 229/62, 80; 150/3

[56] References Cited

U.S. PATENT DOCUMENTS

| | | | |
|---|---|---|---|
| 2,114,367 | 4/1938 | Berkowitz | 229/80 |
| 2,215,989 | 9/1940 | Wolf | 229/80 X |
| 2,274,934 | 3/1942 | Piazze | 229/62 X |
| 2,313,512 | 3/1943 | Brewer | 229/80 |
| 2,314,819 | 3/1943 | Ewer | 229/62 X |
| 2,962,205 | 11/1960 | McFarland | 229/80 X |
| 3,446,420 | 5/1969 | Rinecker | 229/62 |

FOREIGN PATENT DOCUMENTS

| | | | |
|---|---|---|---|
| 1,024,416 | 3/1966 | United Kingdom | 229/62 |

*Primary Examiner*—Stephen P. Garbe

*Attorney, Agent, or Firm*—Hill, Gross, Simpson, Van Santen, Steadman, Chiara & Simpson

[57] ABSTRACT

A bag has an opening on its front side adjacent to its mouth which exposes the inner surface of the rear side, there being a first cohesive coating on such inner surface in registration with the opening, their being a second cohesive coating on the front side adjacent to the opening. After the contents have been placed in the bag, the end of the bag is folded over between the cohesive coatings so that they register with each other, and by their nature they adhere to each other in response to being pressed together.

5 Claims, 4 Drawing Figures

Fig. 1
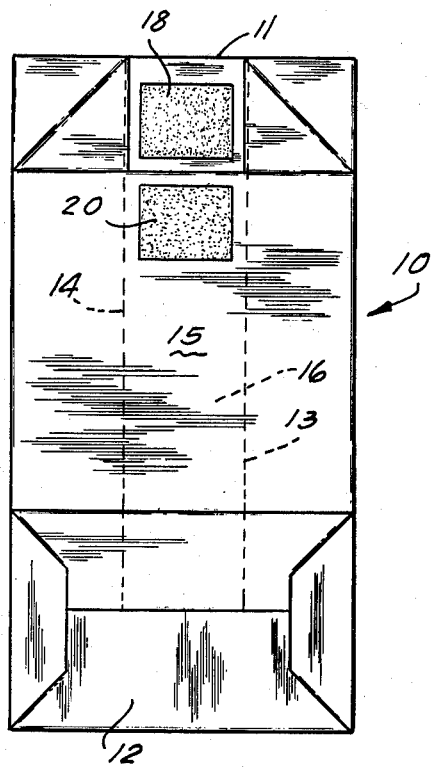
Fig. 4
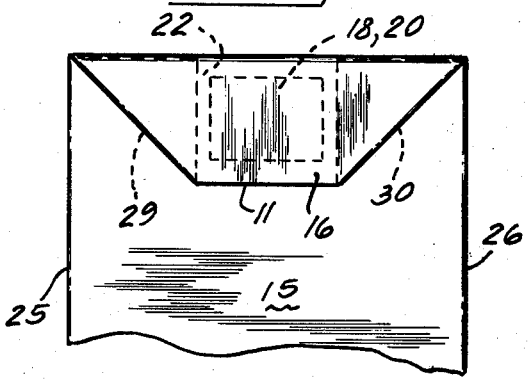
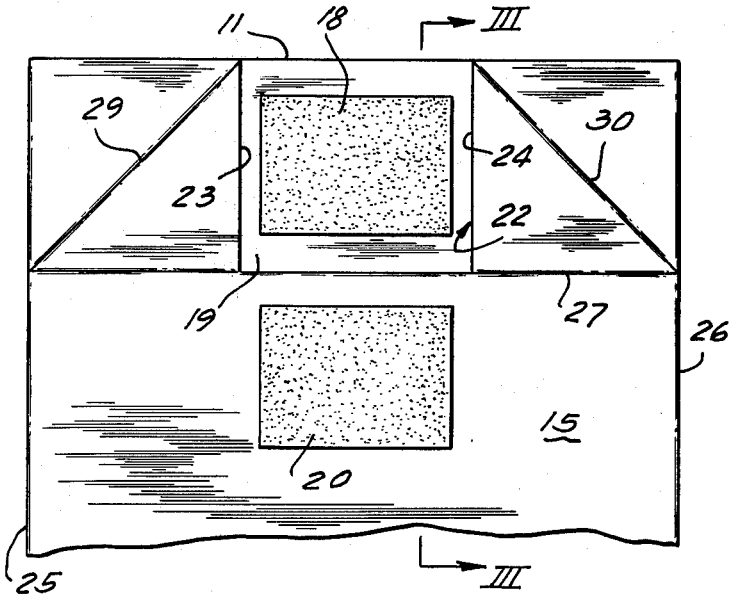
Fig. 2
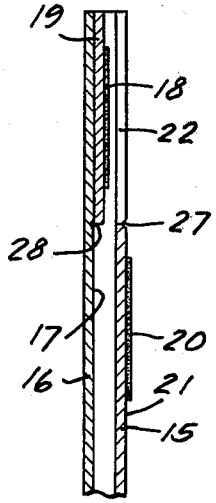
Fig. 3

SELF-CLOSING BAG

BACKGROUND OF THE INVENTION

1. Field of the Invention

This invention is directed to the structure by which the end of a filled bag may be held closed.

2. Prior Art

When bags are used in a retail establishment to hold a customer's purchase, it is most common for the sales person to sort of roll or fold over the end of the bag, which typically is a paper bag, so as to crimp or crease the same into a closed condition. Several types of alternatives have been used such as folding the bag shut coupled with taping or stapling, both of which are inconvenient because of the non-productive labor involved. Further, metal ties have been built into the end structure of the bag, the most common of which is the reclosable bag of the type used for coffee. At the point of manufacture, this type of bag is comparatively expensive, and again the retailer is reluctant to spend more of his money than is necessary for packaging the goods sold.

SUMMARY OF THE INVENTION

According to the present invention, a first cohesive coating is secured to the inner surface of the rear side of a bag, there being an opening in the front side in registration with such coating, and a second cohesive coating disposed on the outer surface of the front side adjacent to such opening, the coatings being in registration with each other when the mouth-end of the bag is folded over between the coatings. Mere force or pressure enables the coatings to adhere to one another, thereby closing the bag. If separated, the coatings readhere to each other to enable re-closing of the bag.

Accordingly, it is an object of the present invention to provide structure at the mouth-end of a bag for enabling the closing thereof using a minimum of labor, no extra material such as a staple or tape, and at a minimum of cost.

Another object of the present invention is to provide a self-closing bag that can be reclosed.

A further object of the present invention is to provide a bag of the type described which can optionally be closed even faster if less air-tightness is acceptable.

A still further object of the present invention is to provide a bag of the type described that can be manufactured from a continuous web of material on conventional bag-making machines.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWING

FIG. 1 is an elevational view of a bag having closing structure provided in accordance with the principles of the present invention;

FIG. 2 is an enlarged view of the mouth-end of the bag of FIG. 1;

FIG. 3 is a cross-sectional view taken along line III—III of FIG. 2 with thicknesses exaggerated; and FIG. 4 is a fragmentary elevational view of the mouth-end of the bag of FIG. 1 shown in closed position.

AS SHOWN ON THE DRAWING

The principles of the present invention are particularly useful when embodied in a bag such as shown in elevation in FIG. 1, generally indicated by the numeral 10. When completely fabricated, the bag can be stored and shipped in a flat condition as shown, and has an open mouth 11 and a closed end or bottom 12 and may have side tucks 13, 14. The construction of the bag remote from the closing structure to be described is conventional and the closing structure of this invention can be applied to many otherwise-known types of bag constructions. However, any bag in a flat condition has a front side 15 and a rear side 16.

According to the invention, the rear side 16 has an inner surface 17 on which a first cohesive coating 18 is carried. In this embodiment, the coating 18 is carried on an insert 19 which is secured to the inner surface 17 in any conventional manner, such as by an adhesive (not shown).

The front side 15 has a second cohesive coating 20 carried on its outer surface 21 adjacent to an opening 22. As best shown in FIG. 2, the opening 22 has a width between its longitudinal edges 23, 24 which is at least one-fourth of the width of the bag 10, such width being the distance between its lateral edges 25, 26. Such definition of width of the bag excludes the tucks 13, 14. The length of the opening 22, namely its extent along the length of its edges 22, 23, is also at least one-fourth of the width of the bag, and thus the opening 22, in this embodiment, is rectangular. In this embodiment, such length of the opening 18 is substantially the same distance that the opening is spaced from the lateral edges 25, 26.

The first cohesive coating 18 covers an area which is more than half of the area of the opening 22, and the two coatings are substantially equal in area and shape.

The front and rear sides 15, 16 are provided with superimposed transverse score lines 27, 28, the score line 27 being interupted by the opening 22. The score lines 27, 28 lie between the coatings 18, 20 and provide a prospective fold line so that the mouth end 11 of the bag 10 may be folded along such lines so that the coating 18 comes into contact with the coating 20. In order to get maximum air-tightness from the closed end, there is also provided in the front and rear sides 15, 16 a pair of similar score lines 29, 30, each numeral representing a pair of superimposed score lines in such front and rear sides 15, 16. These are also prospective fold lines.

In the manufacture of the bag 10, the insert 19 originally comprised a portion of the front side 15, it being the material removed from the front side 15 to provide the opening 20. Thus the periphery of the insert 19 is identical to the periphery of the opening 22. The score lines 29, 30 thus extend from a corner of the insert 19 or from a corner of the opening 22, such corners being at the mouth 11, and extend to the lateral edges 25, 26 at an angle, such angle here being 45°.

After the bag 10 has been filled, any side tucks are folded back into the position shown in FIG. 1, at the mouth 11, and the outer corners of the bag are folded along the score lines 29, 30, toward the viewer in FIG. 2, and then the bag is again folded along the score lines 27, 28 toward the viewer to bring the coatings into contact with one another. As the coatings comprise cohesive material, they stick to each other when the bag has been closed as shown in FIG. 4, and the sticking is made complete by finger-pinching the area lying outside of the coatings 18, 20. If a less air-tight closure is satisfactory and a faster closing is desired, the end or top of the bag is folded only once along the score lines 27, 28 to enable the cohesive surfaces to be pinched together.

The use of the relatively large opening also provides a relatively large thumb notch by which the rear side 16 may be grasped in connection with opening the bag. However, as the cohesive material is not tacky to the touch, but only sticks to other cohesive material, the grasping of the bag between fingers at such point to open the bag does not produce any unwanted sticking to a thumb or finger. Further, the use of the insert 19 provides a double wall thickness which reinforces the bag in the area by which it is grasped. Further, the use of the insert avoids the need for eliminating from the bag-making machine any waste created incidental to the formation of the opening 22. As the insert 19 was initially a portion of the front side 15, the coatings 18, 20 can be provided as a single contiguous area. If that be done, the term "coating" as used herein should be interpreted as being a "coating portion", because ultimately they are carried on the front and rear sides 15, 16 of the bag. The term "cohesive" is known in the trade as meaning something that sticks only to like material in response to pressure, whereas an adhesive will stick to various surfaces.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A self-closing bag comprising: a bag having a front side and a rear side extending to the mouth of the bag, said front side having an opening at the mouth of the bag, a first cohesive coating carried on an insert secured to the inner surface of said rear side in registration with said opening, said insert comprising material removed from said front side to provide said opening, and a second cohesive coating carried on the outer surface of said front side adjacent to said opening and facing the same way for cooperation with said first cohesive coating when the mouth-end of the bag is folded over.

2. A bag according to claim 1 in which said opening extends lengthwise from the mouth of the bag for a distance which is at least one-fourth the width of the bag.

3. A bag according to claim 1 in which said insert has a periphery corresponding substantially to the periphery of said opening.

4. A bag according to claim 1 in which said opening is rectangular, the length of said opening being substantially equal to the distance that said opening is spaced from the lateral edges of said bag.

5. A bag according to claim 4 which includes at least one score line in said front and rear sides, extending between a corner of said opening at the mouth and the lateral edges of said bag at an angle.

* * * * *